US005431876A

United States Patent [19]

Kumar et al.

[11] Patent Number: 5,431,876

[45] Date of Patent: Jul. 11, 1995

[54] ALUMINUM-LITHIUM ALLOYS

[75] Inventors: K. Sharvan Kumar, Baltimore; Joseph R. Pickens, Beltsville, both of Md.

[73] Assignee: Comalco Aluminium Ltd., Melbourne, Australia

[21] Appl. No.: 233,559

[22] Filed: Apr. 26, 1994

Related U.S. Application Data

[63] Continuation of Ser. No. 849,991, Mar. 10, 1992, abandoned, which is a continuation of Ser. No. 376,183, Jul. 6, 1989, abandoned, which is a continuation of Ser. No. 936,197, Dec. 1, 1986, abandoned.

[51] Int. Cl.[6] ..... C22C 21/12

[52] U.S. Cl. ..... 420/529; 148/438; 148/440; 420/533; 420/542; 420/543; 420/545; 420/553; 428/654

[58] Field of Search ..... 428/654; 228/263.17; 420/529, 533, 542, 543, 545, 553; 148/438, 440

[56] References Cited

U.S. PATENT DOCUMENTS

| | | | |
|---|---|---|---|
| 2,381,219 | 8/1945 | LeBaron | 420/529 |
| 4,094,705 | 6/1978 | Sperry et al. | 148/2 |
| 4,526,630 | 7/1985 | Field | 148/159 |
| 4,848,647 | 7/1989 | Gentry et al. | 420/533 |
| 4,851,192 | 7/1989 | Baba et al. | 420/542 |
| 5,032,359 | 7/1991 | Pickens et al. | 420/545 |
| 5,259,897 | 11/1993 | Pickens et al. | 420/533 |

FOREIGN PATENT DOCUMENTS

| | | |
|---|---|---|
| 1161306 | 10/1958 | France . |
| 1519021 | 3/1968 | France . |
| 2538412 | 6/1984 | France . |
| 870261 | 6/1961 | United Kingdom . |
| 1572587 | 7/1980 | United Kingdom . |
| 2115836 | 9/1983 | United Kingdom . |
| 331110 | 4/1972 | U.S.S.R. . |

OTHER PUBLICATIONS

Aluminum-Lithium Alloys II, Proceedings of the Second International Aluminum-Lithium Conference at Monterey, Calif. Apr. 12-14, 1983 (Starke & Sanders eds.), p. 409.

Wadsworth et al, Superplastic properties of an Al-Cu-Zi-Zr alloy, Journal of Materials Science Letters 4 (1985) 674-78.

N.T.I.S. Technical Notes (1986) Sep., No. 9, Part H, Aluminum-Lithium-Copper Alloy Properties.

Aluminum-Lithium Alloys II, Proceedings of the Second International Aluminum-Lithium Conference at Monterey, Calif., Apr. 12-14, 1983 (Starke & Sanders eds.) pp. 219-221.

Mondolfo, *Aluminum Alloys: Structure and Properties* (1976), pp. 495-497, 554-556, 641, 665-671, 693-758, 946.

*Primary Examiner*—David A. Simmons
*Assistant Examiner*—Robert R. Koehler
*Attorney, Agent, or Firm*—Nikaido, Marmelstein, Murray & Oram

[57] ABSTRACT

A group of ternary alloys of aluminum-lithium and magnesium or copper further including at least one additive element such as zirconium, chromium and/or manganese. These alloys have an improved combination of properties such as strength, ductility and weldability and in some cases improved tensile properties at cryogenic temperatures.

14 Claims, No Drawings

ALUMINUM-LITHIUM ALLOYS

This application is a continuation of application Ser. No. 07/849,991 filed Mar. 10, 1992, now abandoned, which is a continuation of U.S. Ser. No. 07/376,183, filed Jul. 6, 1985, now abandoned, which is a continuation of U.S. Ser. No. 06/936,197 filed Dec. 1, 1986, now abandoned.

The present invention relates to alloys of aluminum and lithium that are characterized by a desirable combination of mechanical and physical properties; particularly, low density, medium to high strength, ductility, stiffness, weldability and in some cases good strength and ductility at cryogenic temperatures.

BACKGROUND OF THE INVENTION

Since 1973, the increase in fuel costs has prompted research efforts towards developing more fuel efficient aircraft. One solution would be to reduce the weight of structural components without attendant loss in strength or other desirable properties. Intense research efforts led to the realisation of at least three near-commercial, low density Al-Li alloys; to produced by Alcan in the U.K. and the third by Alcoa in the U.S.A. These three alloys 8090 (sometimes referred to by tradenames as DTDXXXA, Alcan A, or Lital A), 8091 (Alcan B, Lital B, or DTDXXXB) and 2090 (Alcoa B) comprise a new generation of Al-Si alloys. In general, such alloys were developed for aircraft applications where the weight savings effected by using these low-density alloys greatly reduces vehicle fuel costs and also increases performance. Because most aircraft parts are mechanically fastened, the weldability of the Al-Si alloys has received relatively limited attention. If weldable Al-Li alloy variants were available commercially they could potentially be used for many non-aircraft applications, such as, marine hardware, lightweight pressure vessels and the like. Since many pressure vessels are used at low temperatures it would be import and for the structural alloys employed to have good mechanical properties at both room and cryogenic temperatures.

Significant events in the development of aluminum base alloys containing lithium for structural applications were the introduction of the Scleron alloys (Al-Zn-Cu-Li), developed in Germany in the early 1920's; alloy 2020 (Al-Cu-Li-Cd) developed in the United States by Alcoa in the late 1950's; and alloy 01420 (Al-Mg-Li) developed in the USSR in the mid-1960's. Alloys 2020 and 01420 essentially constitute the first generation of Li containing Al alloys used on a commercial scale. Commercial aluminum alloys in the U.S. are sometimes described by four-digit numbers assigned under the standard Aluminum Association designation system which is explained in the "Metals Handbook", Ninth Ed. (American Society for Metals, Metals Park, Ohio, U.S.A.), Vol. 2, pg. 44, (1979).

Aluminum and its alloys have desirable properties such as low cost, good appearance, relatively light weight, fabricability, and corrosion resistance that make them attractive for a wide variety of applications. The aluminum base metal referred to herein is about 99.00% pure with iron and silicon being the major impurities; and where the percentage of aluminum in compositions described herein is not specified it is to be understood that the aluminum makes up the difference between 100% and the sum of the specified elements.

Lithium is the lightest metal found in nature and its addition to aluminum metal is known to significantly reduce density and increase stiffness. Consequently, aluminum-lithium alloys could offer valuable combinations of physical and mechanical properties that would be especially attractive for new technology applications, particularly, in industries such as aircraft and aerospace. Lithium is generally known to produce a series of low density (i.e., light), age hardenable aluminum alloys (Al-Li, Al-Mg-Li, or Al-Cu-Li) but these alloys have been used only to a limited extent because, among other things, they were believed to oxidize excessively during melting, casting and heat treatment (Kirk-Othmer "Encyclopedia of Chemical Technology" 3 Ed., John Wiley (1981) Vol. 2, pg. 169).

One of the early commercial aluminum based systems including lithium is the 01420 family developed by Fridlyander et al. which includes several alloy variants. The 01420 alloys and variants are broadly described in U.K. Patent No. 1,172,738. The alloys disclosed by Fridlyander are said to be high strength, low density and have a modulus of elasticity 15 to 20% higher than standard aluminum alloys, as well as, good corrosion resistance. The ultimate tensile strength claimed for these alloys is 29–39 kg/mm$^2$ and they are comprised of 5 to 6% Mg; 1.8 to 2.4% Li and one or both of 0.05 to 0.2% Zr and 0.5 to 1.0% Mn, the balance being Al. These alloys are basically of the 5XXX Series-type, i.e., their major alloying element is magnesium, and further include lithium. All percents (%) stated herein are percent weight based on the total weight of the alloy unless otherwise indicated.

Another family of aluminum based alloys including lithium is disclosed in U.K. Patent No. 1,572,587 (assigned to Swiss Aluminum Ltd.) and are said to have a combination of unusually advantageous properties including excellent formability, strength and favorable resistance-weldability which results from the increased electrical resistivity induced by lithium. These alloys are typically of the 5XXX Series-type being composed of 1.0 to 5.0% Mg; up to 1% Mn; up to 0.3% Ti; up to 0.2% V and the balance being Al. A 0.3 to 1.0% lithium component is added to increase electrical resistivity. The lithium is in a super-saturated solid solution in the alloy so that ductility, formability and strength properties are improved and retained at elevated temperatures.

Yet another family of aluminum based alloys that may include lithium are the 2XXX (Aluminum Association system), or aluminum-copper alloys. Such a family of alloys is disclosed in U.S. Pat. No. 2,381,219 (assigned to Aluminum Company of America). These alloys are said to have improved tensile properties because they include substantial amounts of copper and small amounts of lithium and at least one other element selected from the cadmium group consisting of cadmium, mercury, silver, tin, indium and zinc. This reference states that lithium is not known to have any pronounced beneficial effect on the tensile properties, i.e., tensile strength, yield strength, elongation or hardness, when not in combination with an alloying element from the cadmium group and that lithium may even be detrimental to tensile properties.

Presently available high strength aluminum lithium alloys do not have good fusion welding properties as reflected by their low resistance to hot tearing. Hot tearing, in general is believed to result from the inability of the solid-liquid region of the weldment to support the strain imposed by solidification shrinkage. Aluminum-lithium alloys are particularly sensitive to hot tearing because of their high coefficient of thermal expansion and high solidification shrinkage. Compositional modifications that enhance weldability may adversely affect other properties such as strength, ductility, stiffness and/or density.

In view of the foregoing, it would be desirable to provide lightweight, high strength, aluminum-lithium alloys having resistance to hot tearing, (good weldability), resistance to cracking during welding and processing, ductility, stiffness, and low density and/or good mechanical properties at cryogenic temperatures.

SUMMARY OF THE INVENTION

It is an object of the present invention to provide aluminum based ternary alloys including lithium that have an improved combination of physical and mechanical properties particularly strength, stiffness, weldability, ductility and low density.

It is another object of the present invention to provide lightweight, high strength, aluminum-lithium alloys having good weldability and good resistance to hot tearing.

It is yet another object of this invention to provide aluminum based ternary alloys including lithium that have an improved combination of physical and mechanical properties at cryogenic temperatures.

The present invention provides a medium to high strength, weldable, ternary alloy consisting essentially of an aluminum base metal; about 1.0 to 2.8% lithium alloying element; an alloying element selected from the group consisting of about 4 to 7% copper and about 2.5 to 7% magnesium; and about 0.01 to 1.00% of at least one additive element preferably selected from the group consisting of zirconium, manganese and chromium. Other additive elements that may be useful are titanium, hafnium, and vanadium.

DETAILED DESCRIPTION OF THE INVENTION

The basic alloying elements of the alloys of the present invention are aluminum, lithium and magnesium or copper in combination with additive elements such as zirconium, manganese and chromium, in amounts sufficient to produce the advantageous combination of mechanical and physical properties achieved by this invention, particularly, lower densities, higher strength, weldability, ductility and in some cases good cryogenic properties. These alloys may also include minor amounts of impurities from the charge materials or picked up during preparation and processing.

The alloys of this invention which employ magnesium as an alloying element can be divided into two categories, i.e., high magnesium about 4 to 7%, preferably about 4.5% and low magnesium about 2.5 to 4%, preferably about 3.0%. The lithium alloying element in the high magnesium alloys is in the range of about 1 to 2.8% and preferably about 1.5% and in the low magnesium alloys about 1 to 2.8%, preferably about 2.4%.

Where copper is employed as an alloying element in the alloys of this invention it is present in the range of about 4.0 to 7.0% preferably about 6.0% and the lithium alloying element is in the range of about 1 to 1.7%.

The additive elements employed in the alloys of this invention include zirconium, manganese and chromium and similar materials. The additive elements preferred for use where magnesium is an alloying element are about 0.01 to 0.7% manganese, about 0.1 to 0.3% zirconium, and about 0.1 to 0.3% chromium; and where copper is an alloying element the preferred additives are about 0.2 to 0.7% manganese and 0.05 to 0.2% zirconium. Titanium may be used in some instances to replace zirconium as an additive element and similarly vanadium may replace chromium.

It should be understood that the nature and quantity of additive elements employed and the relative proportions of the aluminum base metal and magnesium or copper alloying elements can be varied in accordance with this invention as set forth herein to produce alloys having the desired combination of physical and mechanical properties.

The alloys of this invention may be prepared by standard techniques, e.g., casting under vacuum in a chilled mold; homogenizing under argon at about 850° F. and then extruded as flat plates. The extruded plates may be solutionized (typically held at about 850° F. for 1 hour), water quenched, stretch-straightened by 2 to 7% and then aged to various strength levels, generally slightly under peak strength. These alloys may be heat treated and annealed in accordance with well established metal making practice.

The term heat treatment is used herein in its broadest sense and means any heating and/or cooling operations performed on a metal product to modify its mechanical properties, residual stress state or metallurgical structure and, in particular, those operations that increase the strength and hardness of precipitation hardenable aluminum alloys. Non-heat-treatable alloys are those that cannot be significantly strengthened by heating and/or cooling and that are usually cold worked to increase strength.

Annealing operations involve heating a metal product to decrease strength and increase ductility. Descriptions of various heat treating and annealing operations for aluminum and its alloys are found in the Metals Handbook, Ninth Ed., Vol. 2, pp. 28 to 43, supra and the literature references cited therein.

EXAMPLE 1

Sample alloys 1 to 6 having the compositions shown in Table 1 below are prepared as follows:

Appropriate amounts, by weight of standard commercially available master alloys of Al-Cu, Al-Mg, Al-Li, Al-Zr, Al-Mn, Al-Cr, Al-Ti together with 99.99% pure Al are used as the starting charge material. These are loaded into a melting crucible in a vacuum/controlled atmosphere, induction furnace. The furnace chamber is then evacuated and back filled with commercial purity argon. The charge is melted under argon, superheated to about 800° C., deslagged and then the melt is tilt poured into a cast iron/steel mold at 700° C. Prior to pouring, following deslagging, the furnace chamber is pumped down and pouring is accomplished in partial vacuum. The ingots are removed from the mold, homogenized, scalped to extrusion billet dimensions and then hot extruded into flat plates. The plates are subsequently heat-treated as desired.

TABLE 1

Sample Alloy Compositions

| | Sample No. | | | | | |
|---|---|---|---|---|---|---|
| | 1 | 2 | 3 | 4 | 5 | 6 |
| Lithium | 2.69 | 2.56 | 1.68 | 1.77 | 2.68 | 1.44 |
| Magnesium | 3.12 | 3.18 | 4.59 | 4.52 | 4.59 | — |
| Copper | — | — | — | — | — | 6.0 |
| Zirconium | 0.11 | 0.12 | — | 0.10 | 0.11 | 0.11 |

TABLE 1-continued

| | Sample Alloy Compositions | | | | | |
|---|---|---|---|---|---|---|
| | Sample No. | | | | | |
| | 1 | 2 | 3 | 4 | 5 | 6 |
| Chromium | — | 0.12 | 0.11 | — | 0.12 | — |
| Maganese | — | 0.40 | 0.40 | — | 0.41 | 0.40 |

The Youngs Modulus and Specific Modulus (which are measures of an alloy's stiffness) and densities are summarized in Table II below for each of sample alloys 1 to 6.

The Young's modulus was measured using standard techniques employed for such measurement, i.e., modulus measurement using ultrasonic techniques where the velocity of a wave through a medium is dependent on the modulus of the medium. Density measurements were made using the Archimedean principle which gives the density of a material as the ratio of the weight of the material in air to its weight loss in water. Modulus and density measurements were made on the extruded plates. Specific modulus is obtained by dividing modulus of the material by its density.

TABLE II

| Modulus and Density at Room Temperature | | | |
|---|---|---|---|
| Sample No. | Density ($\rho$) lb/in$^3$(g/cc) | Young's Modulus (E) ($\times 10^6$ psi) | Specific Modulus ($E/\rho$)($\times 10^6$) |
| 1 | 0.090(2.49) | 11.60 | 129 |
| 2 | 0.091(2.51) | 11.61 | 128 |
| 3 | 0.092(2.55) | 11.29 | 123 |
| 4 | 0.092(2.55) | 11.26 | 122 |
| 5 | 0.089(2.48) | 11.69 | 131 |
| 6 | 0.098(2.72) | 11.57 | 118 |
| 2219-T81* | 0.103(2.84) | 10.7 | 103 |
| 5083-H321* | 0.096(2.66) | 10.2 | 107 |

From the data presented in Table II it can be seen that the alloys of this invention are stiffer and for the most part lighter than the conventional weldable alloys.

The tensile properties of sample alloys 1 to 6 and commercial alloys 2219-T81 and 5083-H321 are summarized in Table III below.

TABLE III

| Tensile Properties at Room Temperature | | | | | | | |
|---|---|---|---|---|---|---|---|
| Sample No. | Heat-Treatment | Orientation | Yield Strength MPa | Yield Strength (ksi) | Ultimate Strength MPa | Ultimate Strength (ksi) | Elongation (%) |
| 1 | Peak aged | L** | 377 | (54.7) | 507 | (73.5) | 3.4 |
| | | LT** | 354 | (51.3) | 532 | (77.2) | 7.0 |
| 2 | Peak aged | L | 408 | (59.2) | 540 | (78.4) | 3.5 |
| | | LT | 411 | (59.6) | 551 | (80.0) | 5.5 |
| 3 | Peak aged | L | 351 | (50.9) | 456 | (66.1) | 9.4 |
| | | LT | 311 | (45.1) | 431 | (62.5) | 9.4 |
| 4 | Peak aged | L | 339 | (49.2) | 480 | 69.7) | 6.3 |
| | | LT | 341 | (49.5) | 474 | (68.8) | 9.4 |
| 5 | Peak aged | L | 436 | (63.3) | 565 | (82.0) | 4.0 |
| | | LT | 427 | (62.0) | 537 | (77.9) | 4.0 |
| 6 | Peak aged | L | 567 | (82.3) | 624 | (90.6) | 4.0 |
| | | LT | 562 | (81.6) | 592 | (85.9) | 2.5 |
| | 19-TB1* | | 351 | (51.0) | 454 | (66.0) | 10.0 |
| | 83-H321* | | 227 | (33.0) | 317 | (46.0) | 16.0 |

*Handbook "typical" values (Aluminum Standards and Data; Aluminum Assoc. Inc. (1984).
(L) means the longitudinal orientation and (LT) means the long transverse orientation.

From the data presented in Table III it can be seen that the alloys of this invention have substantially greater tensile strength than the conventional weldable aluminum and yet acceptable levels of elongation.

The transverse tensile properties of tungsten inert gas (TIG) bead-on-plate welds on Sample alloys 1 to 5 are summarized in Table IV below.

TABLE IV

| TIG Bead-On-Plate Welds - Transverse Tensile Properties | | | | | |
|---|---|---|---|---|---|
| Sample No. | Apparent Yield Strength MPa | Apparent Yield Strength (ksi) | Ultimate Tensile Strength MPa | Ultimate Tensile Strength (ksi) | Joint Efficiency % Ultimate Strength of Weld / Ultimate Stength of Parent |
| 1 | 297 | (43.1) | 405 | (58.7) | 78.0 |
| 2 | 248 | (36.0) | 385 | (55.9) | 70.0 |
| 3 | 164 | (23.8) | 318 | (46.1) | 74.0 |
| 4 | 210 | (30.5) | 360 | (52.35) | 76.0 |
| 5 | 241 | (35.1) | 403 | (58.5) | 75.0 |
| 2219-T81* | 179 | (26.0) | 262 | (38.0) | 58.0 |
| 5083-H321* | 151 | (22.0) | 303 | (44.0) | 96.0 |

EXAMPLE II

Two Sample alloys 7 and 8 were prepared in the manner of Example 1 and aged at 170° C. for 24 hours. These alloys had the compositions and properties set forth in Table V below.

TABLE V

| Sample No. | 7 | 8 |
|---|---|---|
| Lithium | 2.2 | 1.4 |
| Magnesium | 3.0 | 4.5 |
| Zirconium | 0.12 | 0.12 |
| Chromium | 0.11 | - |
| Density | 2.50 | 2.57 |
| Yield Strength | | |
| (MPa)(L) | 194 | 164 |
| (HPa)(LT) | 181 | 160 |
| Ultimate Tensile Strength | | |
| (MPa)(L) | 388 | 341 |
| (MPa)(LT) | 371 | 356 |
| Elongation | | |
| % (L) | 11.8 | 16.7 |
| % (LT) | 11.9 | 20.0 |

The tensile properties of Sample alloys 7 and 8 at cryogenic temperatures are summarized in Table VI below.

TABLE VI

| Sample No. | Test Temperature °C. | Test Temperature (°F.) | Yield Strength MPa | Yield Strength (ksi) | Ultimate Tensile Strength MPa | Ultimate Tensile Strength (ksi) | Elongation % |
|---|---|---|---|---|---|---|---|
| 7 | −195 | (−320) | 373 | (54.1) | 488 | (70.9) | 3.8 |
| 8 | −252 | (−423) | 278 | (40.3) | 526 | (76.4) | 14.2 |

It can be seen from the data presented in Table VI that the alloys of this invention have acceptable tensile properties at cryogenic temperatures.

While in accordance with the provisions of applicable law this application describes and exemplifies specific alloys of the invention claimed below, those skilled in the art will appreciate that changes within the scope of the claims may be made in the exemplified embodiments without departing from the spirit and scope of the invention and that certain advantages of the invention can be employed without corresponding use of other features.

What is claimed is:

1. An aluminum base alloy welded wrought product having a weld joint having a weld joint efficiency $$\left(\frac{\text{ultimate strength of weld}}{\text{ultimate strength of parent}}\right)$$

of at least 70%, the weld joint having a minimum tensile strength of 46.1 ksi in the naturally aged condition, the welded wrought product produced from an alloy consisting essentially of about 1 to 2.8 wt. % lithium, 2.5 to 7 wt. % magnesium or 4 to 7 wt. % copper, and less than about 1 wt. % of at least one of the elements selected from the group consisting of Zr, Cr and Mn, the balance aluminum, incidental elements and impurities.

2. The wrought product in accordance with claim 1 wherein the weld joint has a minimum tensile strength of at least 52.35 ksi.

3. The wrought product in accordance with claim 1 wherein magnesium is present in the range of 2.5 to 4 wt. % and lithium is present in the range of 1.25 to 2.75 wt. %.

4. The wrought product in accordance with claim 1 wherein magnesium is present in the range of 4 to 7 wt. % and lithium is present in the range of 1 to 1.5 wt. %.

5. The wrought product in accordance with claim 1 wherein copper is present in the range of 4 to 7 wt. % and lithium is present in the range of I to 1.5 wt. %.

6. The wrought product in accordance with claim 1 wherein manganese is present in the range of 0.05 to 0.7 wt. %.

7. The wrought: product in accordance with claim 1 wherein zirconium is present in the range of 0.0 1 to 0.2 wt. %.

8. The wrought product in accordance with claim 1 wherein chromium is present in the range of 0..01 to 0.3 wt. %.

9. The wrought product in accordance with claim 8 wherein manganese is present in the range of 0. 05 to 0. 7 wt. %.

10. An aluminum base alloy welded wrought product having a weld joint having a weld joint efficiency $$\left(\frac{\text{ultimate strength of weld}}{\text{ultimate strength of parent}}\right)$$

of at least 70%, the weld joint having a minimum tensile strength of 46.1 ksi in the naturally aged condition, the wrought product produced from an alloy consisting essentially of about 1 to 2.8 wt. % lithium, 2.5 to 4 wt. % magnesium or 4 to 7 wt. % copper, and less than about 1 wt. % of at least one of the elements selected from the group consisting of Zr, Cr and Mn, the balance comprising aluminum, incidental elements and impurities, the wrought product in the peak aged condition having an ultimate tensile strength greater than about 70 ksi.

11. An aluminum base alloy welded wrought product having a weld joint having a weld joint efficiency $$\left(\frac{\text{ultimate strength of weld}}{\text{ultimate strength of parent}}\right)$$

of at least 70%, the weld joint having a minimum tensile strength of 46.1 ksi in the naturally aged condition, the wrought product produced from an alloy consisting essentially of about 1 to 1.5 wt. % lithium, 4 to 7 wt. % magnesium or 4 to 7 wt. % copper, and less than about 1 wt. % of at least one of the elements selected from the group consisting of Zr, Cr and Mn, the balance aluminum, incidental elements and impurities.

12. An aluminum base alloy welded wrought product having a weld joint having a weld joint efficiency $$\left(\frac{\text{ultimate strength of weld}}{\text{ultimate strength of parent}}\right)$$

of at least 70%, the weld joint having a minimum tensile strength of 52.35 ksi in the naturally aged condition, the wrought product produced from an alloy consisting essentially of about 1 to 2.8 wt. % lithium, 2.5 to 7 wt. % magnesium, or 4 to 7 wt. % copper, and less than about 1 wt. % of at least one of the elements selected from the group consisting of Zr, Cr and Mn, the balance aluminum, incidental elements and impurities, the wrought product in the peak aged condition having an ultimate tensile strength greater than about 70 ksi.

13. An aluminum base alloy welded wrought product having a weld joint having a weld joint efficiency $$\left(\frac{\text{ultimate strength of weld}}{\text{ultimate strength of parent}}\right)$$

of parent of at least 70%, the weld joint having a minimum tensile strength of 46.1 ksi in the naturally aged condition, the wrought product produced from an alloy consisting essentially of about 1.25 to 2.2 wt. % lithium, 3 to 7 wt. % magnesium, and less than about 1 wt. % of at least one of the elements selected from the group consisting of Zr, Cr and Mn, the balance comprising aluminum, incidental elements and impurities.

14. An aluminum base alloy wrought product welded to produce a weld joint having a weld joint efficiency $$\left(\frac{\text{ultimate strength of weld}}{\text{ultimate strength of parent}}\right)$$

of at least 70%, the weld joint having a minimum tensile strength of 46.1 ksi in the naturally aged condition, the wrought product produced from an alloy consisting essentially of about 1 to 1.5 wt. % lithium, 4 to 7 wt. % copper, and less than about 1 wt. % of at least one of the elements selected from the group consisting of Zr, Cr and Mn, the balance comprising aluminum, incidental elements and impurities, the wrought product in peak aged condition having an ultimate yield strength of at least 70 ksi.

* * * * *